US007308759B2

(12) United States Patent
Sperling et al.

(10) Patent No.: US 7,308,759 B2
(45) Date of Patent: Dec. 18, 2007

(54) METHOD FOR PRODUCTION OF A MULTI-LAYER CARBON BRUSH

(75) Inventors: Rainer Sperling, Biebertal (DE); Martin Schwarzer, Schoeffengrund (DE); Rolf Heilmann, Giessen (DE); Bernd Rinn, Biebertal (DE)

(73) Assignee: Schunk Kohlenstofftechnik GmbH, Heuchelheim (DE)

( * ) Notice: Subject to any disclaimer, the term of this patent is extended or adjusted under 35 U.S.C. 154(b) by 373 days.

(21) Appl. No.: 10/505,454

(22) PCT Filed: Mar. 3, 2003

(86) PCT No.: PCT/EP03/02137

§ 371 (c)(1),
(2), (4) Date: Nov. 24, 2004

(87) PCT Pub. No.: WO03/075417

PCT Pub. Date: Sep. 12, 2003

(65) Prior Publication Data

US 2005/0223538 A1 Oct. 13, 2005

(30) Foreign Application Priority Data

Mar. 4, 2002 (DE) ..... 102 09 199

(51) Int. Cl.
*H01R 43/12* (2006.01)

(52) U.S. Cl. ..... 29/826; 29/596; 264/29.1; 264/105; 310/249

(58) Field of Classification Search ..... 29/826, 29/596–598, 734–735; 264/29.1, 29.5, 29.7, 264/259; 164/105, 113, 120; 310/154.11, 310/154.35, 254

See application file for complete search history.

(56) References Cited

U.S. PATENT DOCUMENTS

| | | | | |
|---|---|---|---|---|
| 3,590,300 | A * | 6/1971 | Moberly | 310/248 |
| 3,751,294 | A * | 8/1973 | Fridman et al. | 427/114 |
| 3,906,624 | A * | 9/1975 | Ohta | 29/826 |
| 4,929,404 | A * | 5/1990 | Takahashi et al. | 264/29.5 |
| 5,441,683 | A * | 8/1995 | Kammerer et al. | 264/105 |
| 5,556,704 | A * | 9/1996 | Prevorsek et al. | 428/408 |
| 5,626,803 | A * | 5/1997 | Siegemund | 264/40.5 |
| 6,068,926 | A * | 5/2000 | Sperling et al. | 428/408 |
| 2001/0015590 | A1 | 8/2001 | Katoh et al. | |

FOREIGN PATENT DOCUMENTS

| | | |
|---|---|---|
| DE | 3307090 | 9/1984 |
| DE | 19902938 | 7/2000 |
| DE | 19913599 | 9/2000 |
| JP | 02 094381 | 4/1990 |

* cited by examiner

*Primary Examiner*—Minh Trinh
(74) *Attorney, Agent, or Firm*—Dennison, Schultz & MacDonald

(57) ABSTRACT

A method for production of a multi-layer carbon brush including at least two electrically-conducting functional layers made from carbon material and at least one insulation layer made from an electrically-insulating material, running between consecutive functional layers. According to the invention, the corresponding multi-layer carbon brushes and the layers with desired thickness can be produced by applying the carbon material and the electrically-insulating material in a mold in a sequence corresponding to the layer sequence of the multi-layer carbon brush for production in powder form, then pressed and finally heat-treated.

9 Claims, 2 Drawing Sheets

METHOD FOR PRODUCTION OF A MULTI-LAYER CARBON BRUSH

BACKGROUND OF THE INVENTION

The invention relates to a method for producing a multi-layer carbon brush consisting of at least two first electrically conductive functional layers made of carbon material and at least one insulating layer made of electrically insulating material, running between successive first functional layers.

A multi-layer carbon brush of the aforementioned type is described in DE 199 13 599 A1.

Multi-layer carbon brushes, which consist of carbon bars and insulating layers extending between them, are frequently used for smaller reversible motors such as those found in washing machines. The insulating layer can consist of a film, an insulating adhesive, synthetic resin or one or more powder resins. Due to the higher transverse resistance the current flowing between the two disks of a commutator covered by the carbon brush is reduced, thus improving commutation.

The familiar multi-layer carbon brushes of the type described above are generally produced by aligning initially heat-treated carbon plates with each other in such a manner that allows a film to be inserted between them. The products are then layers together. This method can thereby allow one zone to have a higher copper content than the other.

As described in DE 44 30 745 a carbon brush referred to as a multi-layer sliding contact is comprised of layers each consisting of a conductive powder. To produce the multi-layer sliding contact, two conductive powders are simultaneously poured into a mold in which a heat treatment process is performed following compression. Not only does this method allow the formation of layers through the simultaneous addition of powder to a mold, but it also facilitates the formation of additional layers through the successive placement of electrically conductive powder into the mold.

DE-C-835 428 describes a highly-polished hard coal molded body as an applied arts object and a method for its production. To accomplish this, carbon is added to a mold, pressed, and then pre-sintered before being machined in order to coat or impregnate the body with oil-containing pastes prior to final sintering.

DE-C-636 540 describes a method for producing multi-layer carbon brushes. Finished carbon layers are first smoothed. Tescous resin with an insulating material is then placed between the two finished carbon layers. The carbon layers are then clamped into a special pressing tool to facilitate drying in a furnace.

A method for producing a laminated material made of carbon is described in DE 33 07 090 A1. To achieve the desired end product, films made of thermoplastic resin are placed through pressing and heat-treatment between carbon layers such as carbon felt layers that can be stacked on top of each other, and the stack is then subjected to the desired pressure and temperature levels.

DE 199 02 938 A1 relates to a carbon brush that is composed of sections having different material compositions. In this case, the carbon brush is produced through a pressing process.

A method for producing a laminated material made of carbon is disclosed in DE 33 07 090 A1. To achieve the desired end product, films made of thermoplastic resin may be arranged by means of pressing and heat-treating between carbon layers such as carbon felt layers that can be stacked on top of each other, and the stack is then subjected to the desired pressure and temperature levels.

DE 199 02 938 A1 relates to a carbon brush that is composed of sections having different material compositions. In this case, the carbon brush is produced through a pressing process.

Vrom EP 1 128 496 A1 we know of a starter carbon brush that consists of a first layer made of a material with low resistance and a peripheral layer made of a material with high resistance, which extending from the running surface of the carbon brush ends at a distance to the opposing rear surface. The first and second layers are produced simultaneously in one mold by filling powder into said mold and then performing a pressing step before finally sintering them.

SUMMARY OF THE INVENTION

The object of the present invention is to develop a process for producing a multi-layer carbon brush that consists of at least two electrically conductive functional layers and an insulating layer running between successive functional layers, that constitutes both an improvement and simplification of the current process and which shall also allow for the easy integration of the insulating layer with the application area of the multi-layer carbon brush. The adjustment of material properties such as porosity or friction values shall also be facilitated without difficulty. Moreover, easy individual adjustment of the thickness levels of the functional layers shall be enabled without requiring complex machining measures.

The invention demonstrates that the problem can be essentially resolved by applying layers of the carbon material or carbon-containing material as filler and the electrically insulating material—in powder form—into a mold following a sequence that corresponds to the layer sequence of the multi-layer carbon brush to be produced, then pressing and finally heat-treating the product. In doing so, the insulating material should be added into the mold with an appropriate layer height so that the insulating layer in the finished multi-layer carbon brush has a thickness d of preferably $100\ \mu m \leqq d \leqq 500\ \mu m$.

The invention is particularly characterized by a method for producing multi-layer carbon brushes consisting of at least two electrically conductive functional layers made of carbon material and at least one insulating layer made of electrically insulating material running between successive functional layers and comprises the following procedural steps:

creation of a plate by filling a mold with layers of carbon material or a carbon-containing material in powder form and electrically insulating material in powder form or in the form of a film corresponding to the multi-layer carbon brush to be produced, pressing of the layers present in the mold to form the plate, heat treatment of the plate, and division of plates into sizes corresponding to the multi-layer carbon brushes or their final contours.

Shaping and the insertion of the cord or rope shall be performed according to the current art.

The invention teaches that the manufacture of a mass-produced laminate carbon brush only requires a heat-treating step to facilitate the production of a quantity of multi-layer carbon brushes. By contrast, according to the state of the art the plates made from carbon are either produced separately from each other, or carbon brushes consisting of several layers with electrically conductive properties are produced individually, when the starting materials are initially added to a mold.

The invention specifically suggests for use as the electrically insulating material a synthetic resin powder, organic or inorganic insulating film such as $Al_2O_3$ film, one or more powder resins such as phenol or epoxy resins, tissue film, fiber mat, self-adhesive or adhesive-activated films or combinations thereof.

Below are the specifications of the preferred material composition for the multi-layer carbon brushes to be produced or the plates from which they are to be made. About 50% by weight natural graphite, about 50% by weight synthetic graphite, about 25% by weight phenol or epoxy or thermoplastic resin in powder form, up to about 40% by weight hard coal tar pitch, wherein the latter relates to 100% by weight filler, i.e. natural graphite and synthetic graphite.

The desired quantity of the specified material composition is thus placed in powdered form into a pressing mold layer-by-layer and separated by the electrically insulating material. After the pressing process, it is either heat-treated, e.g. over a period of about 15 h up to a temperature $T_1$ of about 200° C., or annealed up to an end temperature $T_2$ Of about 600° C.

BRIEF DESCRIPTION OF THE DRAWINGS

Further details, benefits and features of the invention are described not only in the claims, the features disclosed in said claims—either alone and/or in combination—, but also in the following description of preferred exemplary embodiments shown in the drawing.

Shown are.

DESCRIPTION OF THE PREFFERED EMBODIENTS

The invention relates to a method for producing a multi-layer carbon brush. In this context, multi-layer carbon brushes shall be defined as brushes in which an insulating layer runs between functional layers consisting of electrically conductive material made of carbon material or carbon-containing material—also referred to a carbon bars. The invention describes a process for manufacturing multi-layer carbon brushes with two or more functional layers.

Figures 1, 2:
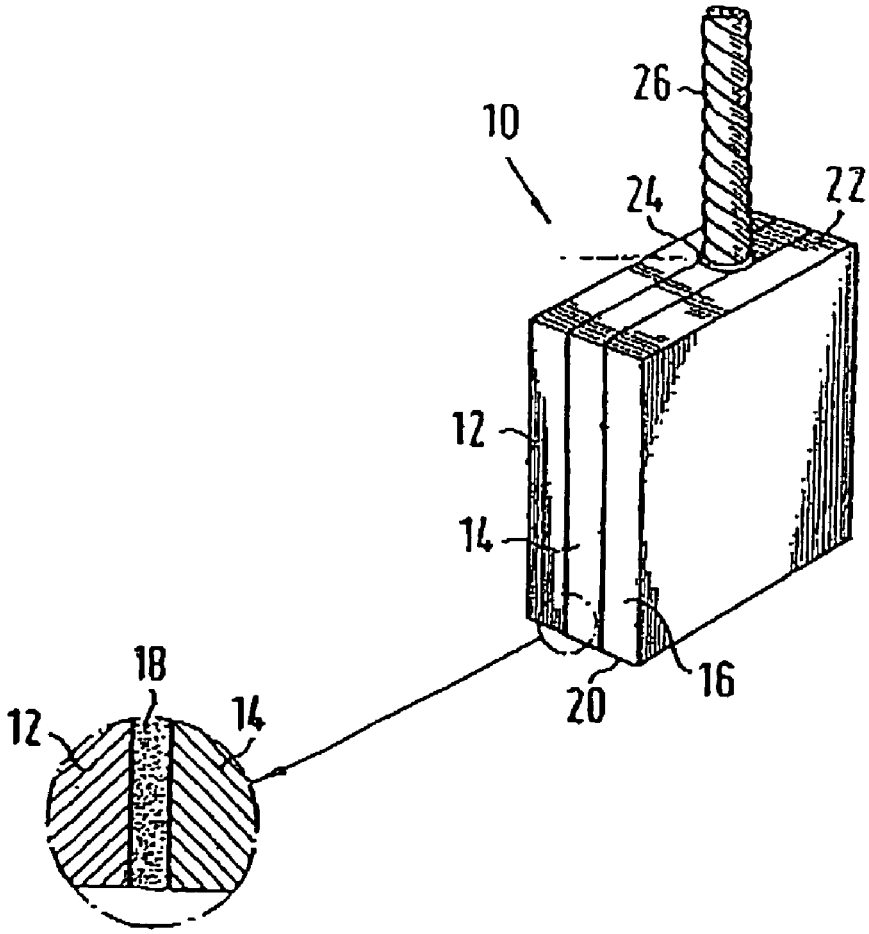
FIG. 1 a schematic illustration of a multi-layer carbon brush with three functional layers, FIG. 2 a part of the carbon brush from FIG. 1, FIG. 3 a schematic illustration of a mold used to produce plates, and FIG. 4 multi-layer plates used to produce multi-layer carbon brushes.
Figure 3:
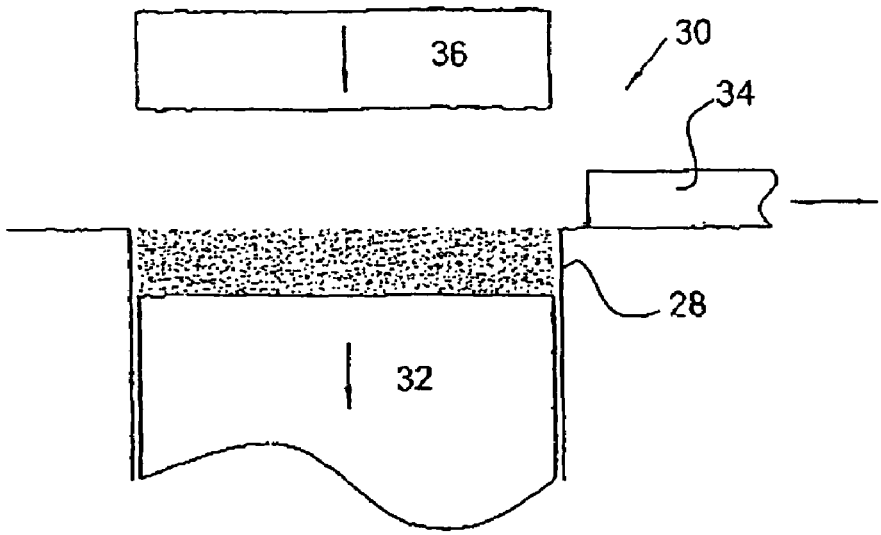

FIG. 1 shows a basic sketch of a multi-layer carbon brush 10 with three carbon bars 12, 14, 16, which are insulated from each other by means of insulating layers 18.

The carbon bars 12, 14, 16 as well as the insulating layers 18 extend perpendicularly to the running surface 20 of the carbon brush. A stamping contact 24 with rope or cord 26 extends from the surface 22 opposite the running surface 20. Regarding this feature, however, reference shall be made to already known designs of multi-layer carbon brushes of the type described above.

The invention proposes the production of multi-layer carbon brushes through the successive addition of the materials forming the individual layers 12, 14, 16, 18 in the desired layer sequence into a die 28 of a pressing device 30. In the die 28 a stamp 32 is arranged adjustably to allow the die 28 to be filled with the various materials in the desired quantity. After the material for a respective layer has been placed in the die, excess material is removed by means of a slide 34. After the desired materials made of carbon and those composed of electrically insulating material have been placed in the die 28 layer-by-layer, the layers are pressed into form by means of a stamp 36. It is provided pursuant to the invention that the cross-section of the die 28 is selected such that it leads to a multi-layer plate 38, which upon removal from the die 28 and upon heat-treating can be divided in the familiar fashion into sections 40, 42, 44, the dimensions of which correspond to the multi-layer carbon brushes to be produced. Shaping of the sections 40, 42, 44 and insertion of the rope are performed in the familiar fashion.

Figure 4:
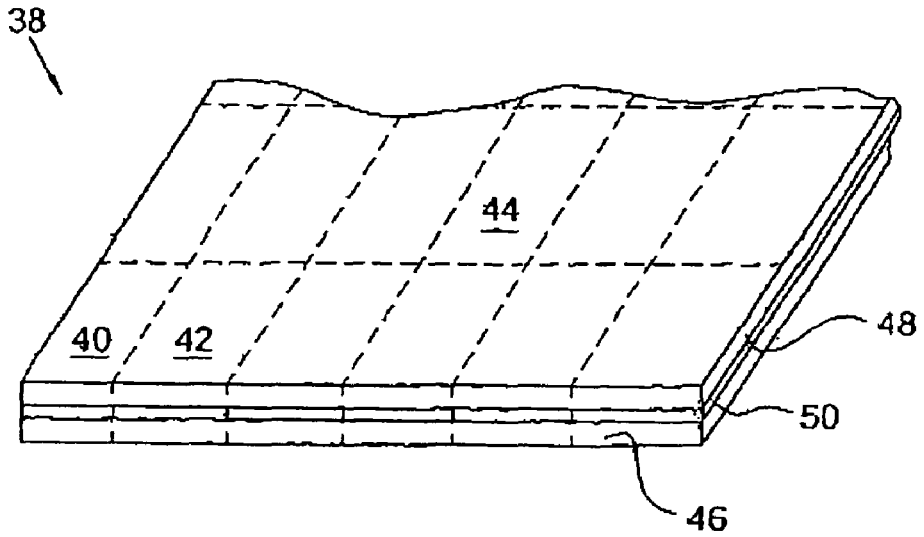

The plate 38 shown in FIG. 4 comprises the functional layers 46, 48 consisting of carbon material, between which the layer 50 consisting of electrically insulating material runs.

If the insulating layer 18, 30 is obtained preferably through a pressing process involving powdered materials, then film made from electrically insulating material can be placed between the individual layers consisting of carbon material, which can then be pressed in a die 28 with the carbon material or carbon containing material in the die 28.

The following types of films can be used: inorganic or organic films such as e.g. $Al_2O_3$ film, tissue films or fiber mats, self-adhesive or adhesive-activated films can be used. The films may have to be activated.

The invention teaches that it is possible to produce multi-layer carbon brushes in a simple manner, wherein said brushes have insulating layers with desired levels of thickness. In this case, it is therefore only necessary to fill the pressing mold 30 with the desired quantity of insulating material. However, insulating material should be added in such a quantity to allow for an insulating layer thickness of between 100 μm and 500 μm following the pressing of materials.

Independent thereof, desired material properties of the individual layers, such as porosity, can be easily modified by adjusting, for example, fill levels or pressing parameters.

The invention claimed is:

1. Method for producing a plurality of multi-layer carbon brushes, each of said brushes comprising, at least two electrically conductive functional layers made of carbon material and at least one layer made of electrically insulating material disposed between said electrically conductive layers, comprising the steps of:

placing into a mold layers of carbon-containing material in powder form, and electrically insulating material in powder or film form, in a sequence corresponding to the sequence of the multi-layer carbon brushes to be produced, pressing the layers in the mold to form a plate, heat treating the plate, and dividing the heat treated plate into said plurality of brushes.

2. The method of claim 1, wherein the electrically conductive material is at least one material selected from the group consisting of a synthetic resin powder, an organic film, an inorganic film tissue film, a fiber mat, and a self-adhesive or adhesive-activated film.

3. The method of claim 2, wherein inorganic film comprises $Al_2O_3$ film.

4. The method of claim 2, wherein the synthetic resin is phenol or epoxy resins.

5. The method of claim 1, wherein the electrically conductive powder is at least one powder selected from the group consisting of natural graphite, synthetic graphite, phenol resin and pitch.

6. The method of claim 1, wherein the carbon-containing material comprises about 50% by weight natural graphite and about 50% by weight synthetic graphite.

7. The method of claim 1, wherein the carbon-containing material comprises about 25% by weight of phenol resin or about 40% by weight of pitch.

8. The method of claim 1, wherein the carbon-containing material comprises about 50% by weight of natural graphite.

9. The method of claim 1, wherein the insulating material is present in an amount sufficient that the insulating layer in the resultant brushes is between 100 and 500 μm after pressing.

* * * * *

UNITED STATES PATENT AND TRADEMARK OFFICE

CERTIFICATE OF CORRECTION

PATENT NO. : 7,308,759 B2
APPLICATION NO. : 10/505454
DATED : December 18, 2007
INVENTOR(S) : Rainer Sperling et al.

It is certified that error appears in the above-identified patent and that said Letters Patent is hereby corrected as shown below:

IN THE CLAIMS:

Column 4, lines 61 and 62, change “conductive” to --insulating--.

Signed and Sealed this

Second Day of December, 2008

JON W. DUDAS
*Director of the United States Patent and Trademark Office*